US006321754B1

(12) United States Patent
Manabe et al.

(10) Patent No.: US 6,321,754 B1
(45) **Date of Patent: *Nov. 27, 2001**

(54) TANK WASHING APPARATUS AND METHOD

(75) Inventors: Nobuyuki Manabe, Fujisawa; Takahiro Goto, Yachiyo, both of (JP)

(73) Assignee: Taiho Industries Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,563

(22) Filed: Jan. 13, 1999

(30) Foreign Application Priority Data

Jan. 21, 1998 (JP) ..... 10-009397

(51) Int. Cl.[7] ..... B08B 9/04

(52) U.S. Cl. ..... 130/22.12; 134/167 C; 134/167 R; 134/172; 134/113

(58) Field of Search ..... 134/22.12, 167 R, 134/168 R, 172, 113, 56 R, 57 R, 167 C, 169 C; 235/97

(56) References Cited

U.S. PATENT DOCUMENTS

| | | | | |
|---|---|---|---|---|
| 1,857,766 | * | 5/1932 | Peterson | 134/167 R |
| 2,109,075 | * | 2/1938 | Ruth | 134/167 R |
| 2,116,935 | * | 5/1938 | Richard et al. | 134/167 R |
| 2,681,250 | * | 1/1953 | Metcalf et al. | 134/167 R |
| 2,858,836 | * | 11/1958 | Geh et al. | 134/167 R |
| 3,150,669 | * | 4/1962 | Green | 134/167 R |
| 3,595,256 | * | 7/1971 | Waltman | 134/167 R |
| 3,645,452 | * | 2/1972 | Stoeckel et al. | 134/167 R |
| 3,741,808 | * | 6/1973 | Stalker | 134/167 R |
| 4,163,455 | * | 8/1979 | Hebert et al. . | |
| 4,393,920 | * | 7/1983 | Shima et al. . | |
| 4,577,411 | * | 3/1986 | Martin . | |
| 4,646,768 | * | 3/1987 | Tanaka et al. . | |
| 4,770,711 | | 9/1988 | Deal, III et al. . | |
| 4,784,166 | * | 11/1988 | Brager et al. . | |
| 4,817,653 | | 4/1989 | Krajicek et al. . | |
| 5,009,242 | * | 4/1991 | Prange . | |
| 5,035,556 | * | 7/1991 | Lamotte et al. . | |
| 5,065,703 | * | 11/1991 | Lee . | |
| 5,293,887 | * | 3/1994 | Thibodeaux . | |
| 5,522,410 | * | 6/1996 | Meilleur | 134/57 R |
| 5,563,787 | * | 10/1996 | Murayama . | |
| 5,640,982 | | 6/1997 | Landry et al. . | |
| 5,642,745 | * | 7/1997 | Landry et al. . | |
| 5,740,821 | * | 4/1998 | Arnold . | |
| 5,932,026 | * | 8/1999 | Trampusch | 134/7 |
| 5,944,036 | * | 8/1999 | Allen . | |

FOREIGN PATENT DOCUMENTS

| | | |
|---|---|---|
| 42 22 007 | 1/1994 | (DE) . |
| 2 227 647 | 8/1990 | (GB) . |
| 315327 | 9/1997 | (TW) . |

* cited by examiner

*Primary Examiner*—Frankie L. Stinson
(74) *Attorney, Agent, or Firm*—Oblon, Spivak, McClelland, Maier & Neustadt, P.C.

(57) ABSTRACT

A tank washing apparatus includes a cover that can be attached to a manhole or other such through-hole in a tank. Washing is effected by liquid sprayed under high-pressure by a spraying machine that is mounted on a travelling apparatus that can be operated from outside the tank to be moved around on the floor of the tank. A washing liquid supply conduit is connected to the spraying machine via the cover.

5 Claims, 6 Drawing Sheets

TANK WASHING APPARATUS AND METHOD

BACKGROUND OF THE INVENTION

1. Field of the Invention

This invention relates to an apparatus for washing tanks to clean out, for example, sludge and other such solid matter that collects at the bottom of crude oil tanks and other such tanks used to store relatively large quantities of liquid, and to a tank washing method using the apparatus.

2. Description of the Prior Art

Manually washing out large-capacity tanks such as tanks used to store crude oil is a lengthy process, involving as it does the risk of fire and health risks in a closed environment. In addition, it is difficult to recover oil components from tank sludge. Owing to such factors, a method of washing tanks that is in widespread use involves the use of a machine that emits a pressurized jet spray of washing liquid, the machine being installed in the floating roof or other such roof portion of the tank with the spray directed into the tank. Sludge that has collected at the bottom of the tank is thus broken down and cleaned out by spraying the sludge with clean oil or the like under pressure (U.S. Pat. No. 4,426,233).

At the time of the washing process the floating roof in which the spraying machine is installed is at a height of around two meters from the floor of the tank. This means that the effective floor washing distance of the washing liquid sprayed from the spraying machine is short, which necessitates the installation of multiple spraying machines. A floating roof type tank having a diameter of 100 meters and a height of 20 meters, for example, is equipped with some 35 spraying machines. However, this type of arrangement has a number of problems, including the following.

1. Many spraying machines are required. Large quantities of equipment such as pipes and valves, are required for the temporary installations.

2. Installing and removing the equipment requires a lot of man hours and time.

3. Large lifting equipment is required to hoist the equipment onto the roof and remove it.

4. The large number of spraying machines involved makes the operation and maintenance thereof complicated.

5. While an installation may comprise as many as 30 or more spraying machines, there are times when only two or three can be operated, so the operating efficiency of the spraying machines is poor.

6. Replacement and maintenance of spraying machines take time and work, with the workers involved having to raise and lower the tank of 20-meter height each time. Thus, any problems such as leaks happening to equipment on the roof cannot be promptly tackled.

7. Some roof supports are removed to install spraying machines, increasing the load on the surrounding parts of the removed roof supports, which is undesirable in terms of strength and safety.

8. The large numbers of man hours and large quantities of equipment involved push up the costs.

An object of the present invention is to provide a tank washing apparatus and method that can be readily set up, reliably fluidize accumulated solid matter such as sludge and efficiently expel the same from the tank, regardless of what liquid has been stored in the tank.

SUMMARY OF THE INVENTION

Equipment installations on the roof of the tank can be substantially or completely eliminated and temporary installations and washing operations implemented on the ground by the method and structure described below.

A spraying machine that sprays washing liquid is inserted into a manhole, mixer hole or other such through-hole provided in a lower side wall portion of the tank, and the spraying machine operated therein.

The number of such through-holes is limited to three or four, so the number of installed washing apparatuses is also thus limited. If each of such a small number of washing apparatuses is used in a fixed location, the effective washing distance of the washing apparatuses (spraying machines) will not be enough to cover the total area inside the tank, so there will remain some portions that are not sufficiently washed.

To avoid this, in accordance with the present invention the spraying machine that sprays the washing liquid is moved within the tank.

Specifically, in order to attain the above object, the present invention provides a tank washing apparatus comprising a cover that is detachably attached to a through-hole in a tank, a travelling apparatus that is movable as desired by being operated from outside the tank, a spraying machine that is mounted on the travelling apparatus for spraying washing liquid, and a supply conduit for supplying washing liquid, the supply conduit being connected to the spraying machine via the cover.

The above object is also attained by a method of washing a tank using the tank washing apparatus, comprising moving the travelling apparatus that is movable as desired by being operated from outside the tank and using a jet of washing liquid sprayed under high pressure from the spraying machine to fluidize solid matter including sludge on a floor portion of the tank.

The travelling apparatus used in this invention is one that is able to move even in the presence of oil and sludge. The travel structure may be a vacuum suction system, a caterpillar system, a crawler system or other such type of system.

The travelling apparatus can be remotely operated from outside the tank. This remote operation can be effected by, for example, mounting a hydraulic motor on the travelling apparatus and externally controlling the supply of hydraulic fluid to the hydraulic motor. However, the method of operation is not limited thereto, and any operating method may be employed.

The spraying machine mounted on the travelling apparatus may be equipped with a mechanism for effecting turning and reciprocating motion in vertical and horizontal directions, and an arrangement may be used that allows the angle of reciprocation and reciprocation velocity to be adjusted. It can also be made possible to effect such an operation from outside the tank.

Other than that the supply conduit for supplying washing liquid to the spraying machines does not restrict the movement of the travelling apparatus, there is no particular limitation on the material or structure of the supply conduit. The conduit may, for example, be in the form of a pipe constituted of a flexible material, or a telescopic pipe, or a movable pipe.

Thus, instead of the conventional arrangement in which washing apparatuses are installed on the roof of the tank, the washing apparatus of the present invention is inserted into the tank via a through-hole such as a manhole or mixer hole in the lower part of the side wall of the tank. Then, inside, the washing apparatus is moved around on the floor of the tank as desired to effect the washing operation. This makes it possible to wash a tank efficiently using a low number of washing apparatuses. In addition, it makes the piping work easier and enables the operation to be done in safety.

Further features of the invention, its nature and various advantages will be more apparent from the accompanying drawings and following detailed description of the invention.

BRIEF DESCRIPTION OF THE DRAWINGS

FIG. 3 (*b*) is a side view of the travelling apparatus shown in FIG. 3 (*a*).

FIG. 3 (*c*) is an explanatory view showing how the jet nozzle of the spraying machine mounted on the travelling apparatus shown in FIG. 3 (*a*) is moved.

FIG. 4 (*b*) is a side cross-sectional view of the washing apparatus shown in FIG. 4 (*a*).

FIG. 5 (*b*) is a side cross-sectional view of the washing apparatus shown in FIG. 5 (*a*).

FIG. 7 (*b*) is a side cross-sectional view of the washing apparatus shown in FIG. 7 (*a*).

DESCRIPTION OF THE PREFERRED EMBODIMENT

Figure 1:
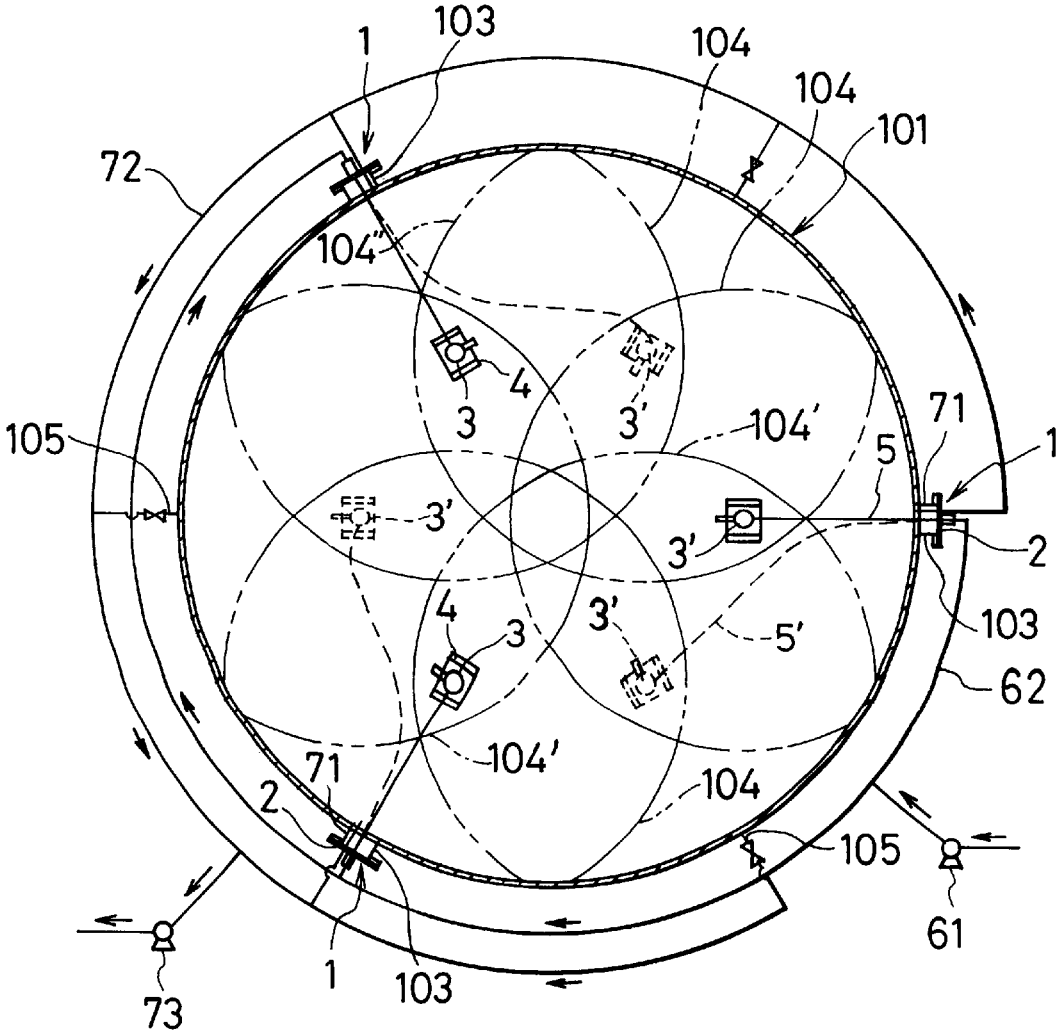
FIG. 1 is a plan view of an embodiment of the washing apparatus according to the present invention.
Figure 2:
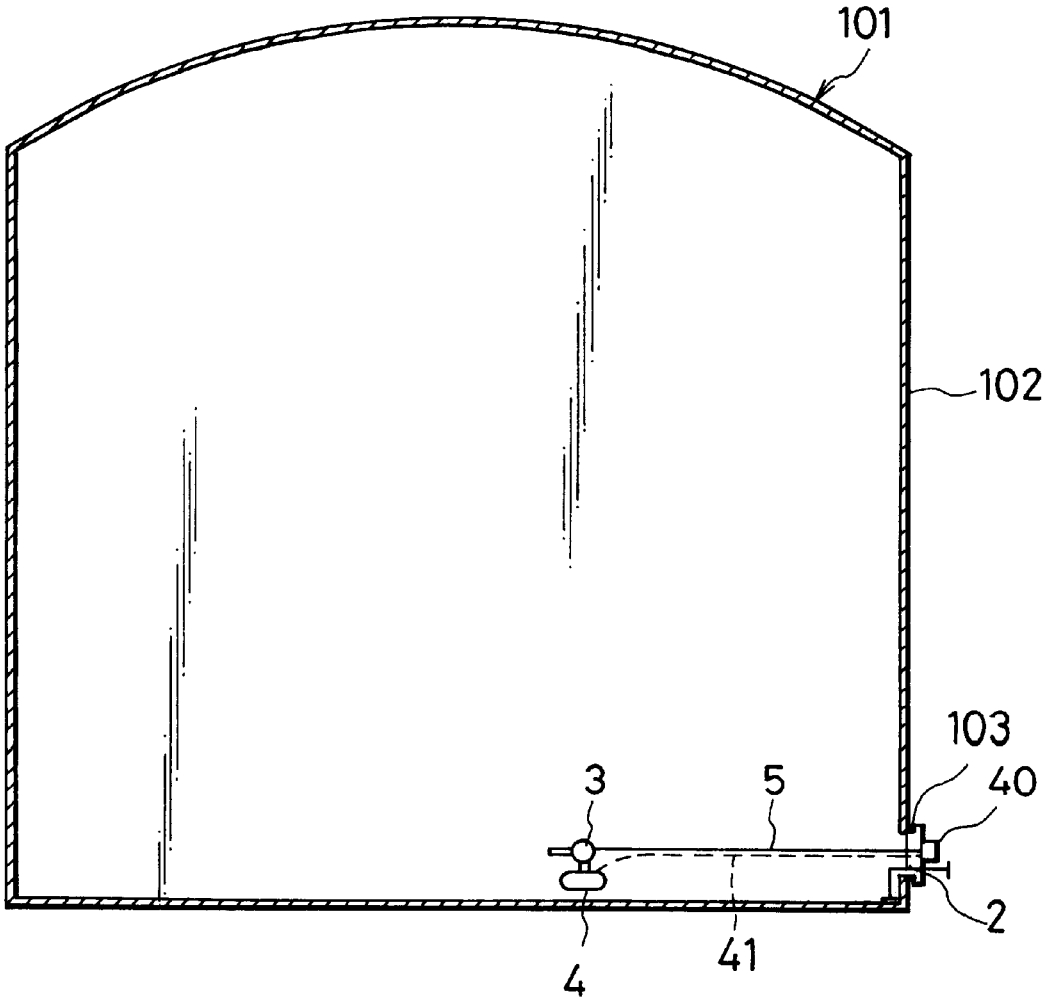
FIG. 2 is a side cross-sectional view illustrating the washing apparatus of the present invention inserted in a tank.

FIGS. 1 and 2 show a washing apparatus 1 that is an embodiment of the present invention. The washing apparatus 1 includes a cover 2 that can be detachably attached to a manhole 103 provided in the lower part of a side wall 102 of a tank 101, and a travelling apparatus 4 on which is mounted a spraying machine 3 for spraying washing liquid. The travelling apparatus 4 used in this invention uses a travel structure such as a vacuum suction system, a caterpillar system or a crawler system that is able to reliably travel even in the presence of oil and sludge. The travelling apparatus 4 incorporates a drive source (not shown) that uses the supply of a hydraulic drive fluid to control the direction and speed of travel. The control unit 40 of the travelling apparatus 4 is attached to the cover 2, allowing the travelling apparatus 4 to be operated from outside the tank to move the travelling apparatus 4 freely around inside the tank. The supply conduit 5 used to supply the washing liquid passes through the cover 2 and is connected to the spraying machine 3.

The tank 101 contains sludge from the crude oil or other types of oil that has been stored in the tank. A plurality of appropriately spaced manholes 103 are provided in the lower part of the side wall 102 of the tank 101. Attached to each of the manholes 103 is an ordinary cover that can be removed. When using the washing apparatus 1 of the present invention, these covers are replaced by the covers 2.

In the embodiment illustrated by FIG. 1, the lower side wall 102 of the tank 101 is provided with manholes 103 at three locations, each of which is fitted with a washing apparatus 1. The washing liquid supply lines and drainage lines are connected respectively to the washing apparatuses 1.

Specifically, washing liquid pumped by a pump 61 is delivered via pipe 62 and supply conduits 5 (5') inside the tank 101, to spraying machines 3 (3') on the travelling apparatuses 4.

Sludge broken down inside the tank 101 is fluidized and, via existing drainage vents 105, a drainage vent 71 in each cover 2 and a pipe 72, is pumped outside the tank 101 by a pump 73.

As described above, each spraying machine 3 can be moved, mounted on a travelling apparatus 4. Therefore, if each of the travelling apparatuses 4 is moved straight ahead a set distance from the manholes 103, each supply conduit 5 is straightened and each of the spraying machines 3 is moved to the position indicated by a solid line. The single-dot broken line 104 indicates the effective washing distance of each spraying machine 3 at that position.

When the travelling apparatuses 4 are then each moved forward to the left, to the position indicated by the dotted line, each of the supply conduits 5 becomes curved as indicated by 5'. The two-dot broken line 104' indicates the effective washing distance of a spraying machine 3' located at the position.

This shows that the entire area of the tank 101 can be washed using a low number of spraying machines, by moving the spraying machines around inside the tank 101. The travelling apparatuses 4 are used to move the spraying machines 3 around to where the spraying machines 3 need to be operated, which is where sludge has built up inside the tank 101.

In FIG. 2, reference numeral 40 denotes a control unit used to control the drive of the travelling apparatus 4 and spraying machine 4, and numeral 41 denotes a hydraulic line (dotted line) that transmits the control operations. With this arrangement, as the supply conduit 5 follows the movement of the travelling apparatus 4, the movement of the travelling apparatus 4 is not impeded or constrained.

Figure 3A:
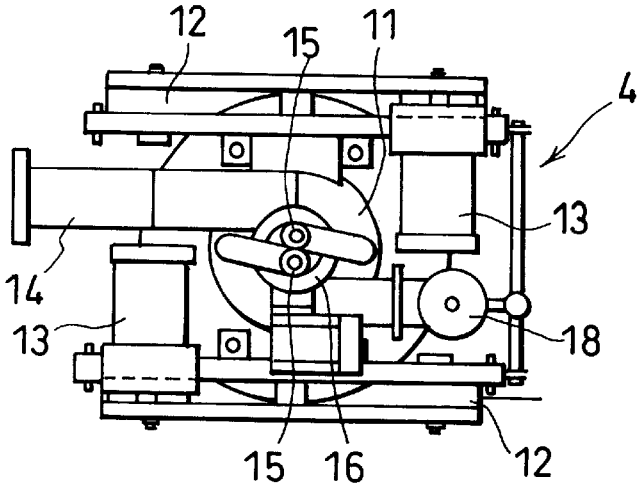
FIG. 3 (*a*) is a plan view illustrating one example of the travelling apparatus used in the washing apparatus according to the present invention.
Figure 3B:
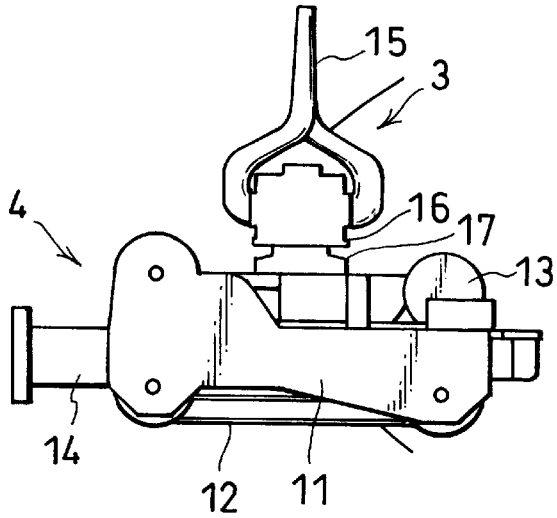
Figure 3C:
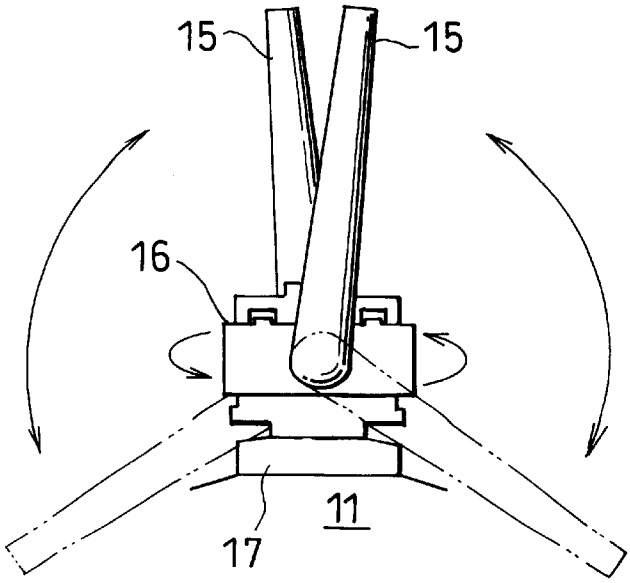

FIG. 3 (*a*) and FIG. 3 (*b*) illustrate one example of the travelling apparatus 4 used in the present invention. It is equipped with a body 11, a caterpillar 12 provided on the lower portion of the body 11 for permitting the travelling apparatus to travel, a hydraulic motor 13 for driving the caterpillar 12, and a supply vent 14 connected to the supply conduit 5 for supplying washing liquid to the spraying machine 3.

The spraying machine 3 mounted on the travelling apparatus 4 comprises a pair of jet nozzles 15, a casing 16 that supports the jet nozzles 15 thereon, a frame 17 provided on the body 11 of the travelling apparatus 4 for rotatably supporting the casing 16 thereon, and a drive unit 18 that drives the jet nozzles 15.

As shown in FIG. 3 (*c*), the pair of jet nozzles 15 swing in the opposite directions on the casing 16, and the casing 16 rotates in a predetermined direction on the frame 17.

The inside of the tank 101 is washed by the following procedures using the travelling apparatus 4. First, the supply conduit 5 is connected to the supply vent 14. At the same time, the control unit 40 mounted on the tank 101 for controlling the drive of the travelling apparatus 4 and spraying machine 3, and the hydraulic motor 13 and drive unit 18 mounted on the travelling apparatus 4 are connected to each other via the hydraulic line 41.

The control unit 40 is operated to move the travelling apparatus 4 to a location to be washed inside the tank. While the pair of jet nozzles 15 are directed to predetermined points, washing liquid is fed to the spraying machine 3 on the travelling apparatus 4 via the supply conduit 5 and jetted from the jet nozzles 15. Washing is thus initiated. During the washing, the nozzles 15 are swung and the casing 16 is rotated. Thus, washing is carried out over a wide range. As a result, sludge is broken down and fluidized. Then, the control unit 40 is again operated to move the travelling apparatus 4 to another location where sludge still exists, and washing is again initiated there.

By using the travelling apparatus 4 with the pair of jet nozzles 15, 180°-rotation of the casing 16 enables the area indicated by single-dot broken line 104 in FIG. 1 to be washed.

The location of a travelling apparatus inside the tank can be confirmed using a method based on an estimation derived from the control track of the hydraulic motor. Another method that can be used involves equipping the travelling apparatus with a light-emitting device that emits light via an optical fiber, enabling the position to be confirmed by observation through a peek-hole provided in the manhole. The position can also be confirmed by a method involving attaching a light-emitting device or other such transmitter to the travelling apparatus, and providing corresponding receivers at appropriate locations, or the method could include making received signals visible. The method to be used is not limited to the methods described here.

Figure 4A:
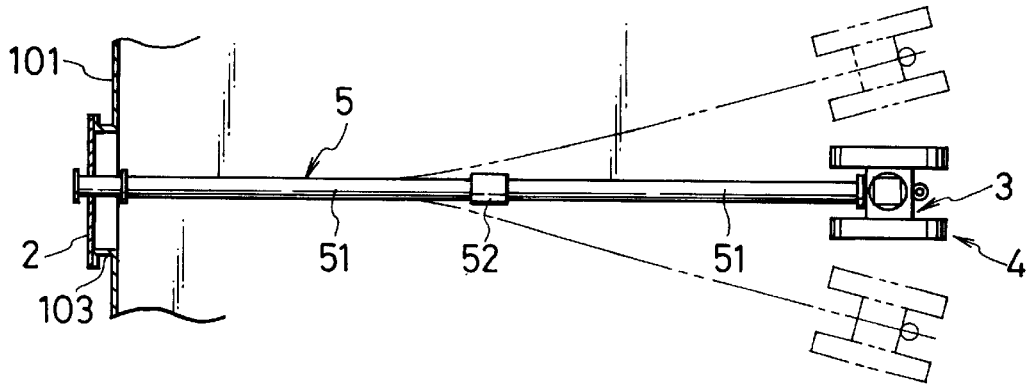
FIG. 4 (*a*) is a plan view of another embodiment of the washing apparatus of the present invention in which the supply conduit is a flexible hose.
Figure 4B:
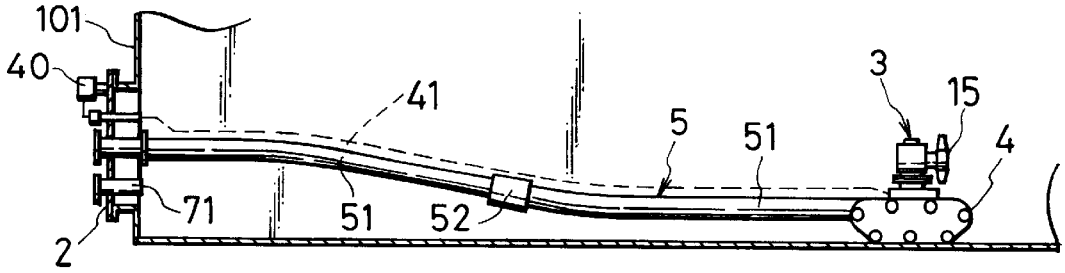

FIG. 4 shows a flexible hose 51 used to constitute the supply conduit 5 for supplying washing liquid to the spraying machine 3. Reference numeral 52 denotes a hose joint.

The necessary length of the flexible hose 51 to allow the free movement of the travelling apparatus 4 inside the tank 101 may be left on the inside or outside of the cover 2. If the length of flexible hose 51 is disposed on the outside, it is desirable for the hole in the cover 2 through which the hose 51 passes to be fitted with a structure (not shown) that provides a seal between the interior and exterior of the tank 101.

Figure 5A:
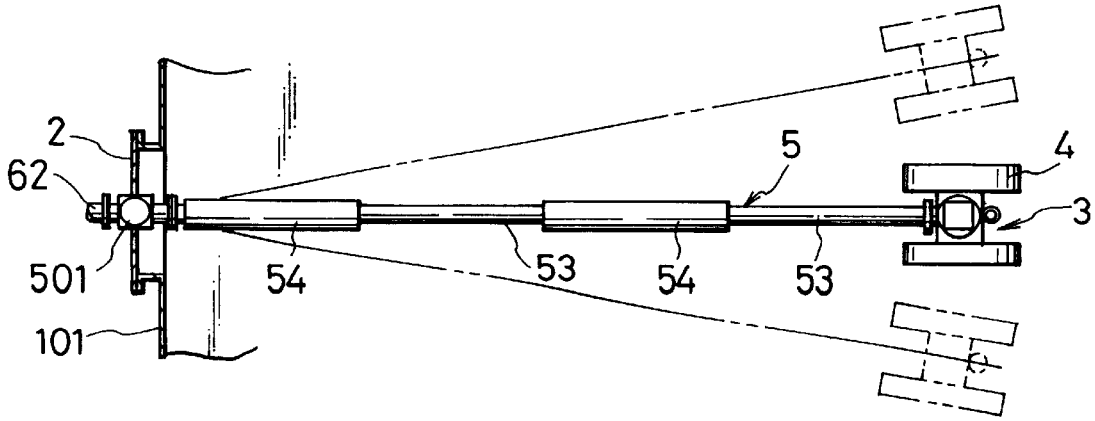
FIG. 5 (*a*) is a plan view of another embodiment of the washing apparatus of the present invention in which the supply conduit is a telescopic steel pipe.
Figure 5B:
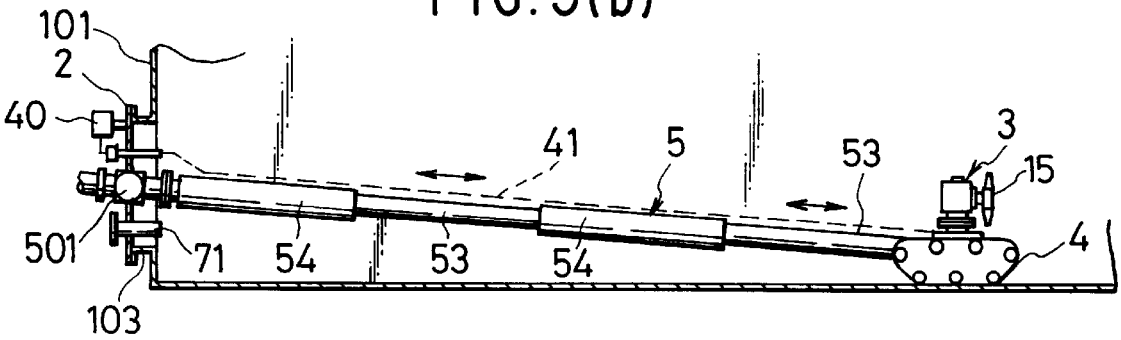

FIG. 5 shows a telescopic steel pipe comprised of steel pipes 53 and 54 used to constitute the supply conduit 5 for supplying washing liquid to the spraying machine 3. Reference numeral 501 denotes an airtight universal joint that does not restrict the lateral movement of the travelling apparatus 4 (spraying machine 3). As in the arrangement shown in FIG. 4, reference numeral 40 in FIG. 5 denotes a control unit used to control the drive of the travelling apparatus 4 and spraying machine 3, and numeral 41 denotes a hydraulic line used to transmit control operations. Joints that may be used as the universal joint 501 include a ball joint, an elbow joint fitted with a hose, a loose coupling, and a joint having a freely adjustable angle of inclination.

Figure 6:
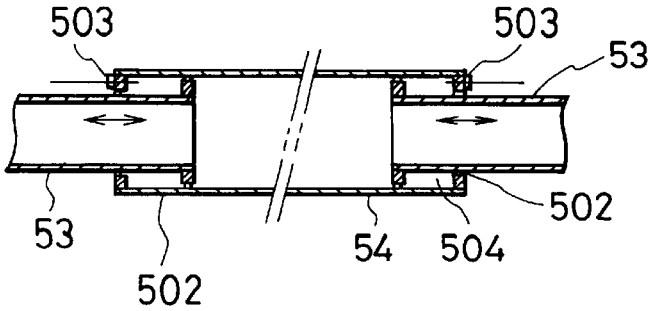
FIG. 6 is a side cross-sectional view showing the telescopic mechanism of the washing apparatus shown in FIG. 5.

As shown in FIG. 6, the telescopic mechanism comprises an inner steel pipe 53 and an outer steel pipe 54 that are connected together via a seal mechanism 502 provided on the end portion of each pipe. The end portions of the outer pipe 54 are provided with a nozzle 503 used to inject a liquid or gas. The supply conduit 5 is lengthened by filling the pipes 53 and 54 with a gas or liquid under pressure. However, a space portion 504 between the ends of the pipes 53 and 54 is not subjected to internal pressure. That is, part of a gas/liquid delivery line (not shown) connected to the nozzle 503 is left unpressurized. To contract the supply conduit 5, a state is effected in which pressure is not applied inside the pipes 53 and 54, and pressurized gas or liquid is fed into the space portion 504 via the nozzle 503. The seal mechanism 502 is one that does not lose its sealing capability during the sliding motion accompanying extension and contraction of the supply conduit 5.

Figure 7A:
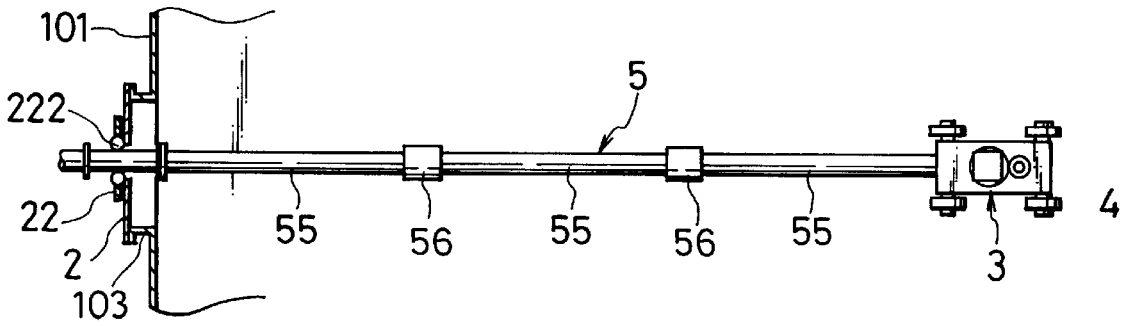
FIG. 7 (*a*) is a plan view of another embodiment of the washing apparatus of the present invention in which the supply conduit is comprised of steel pipes and joints.
Figure 7B:
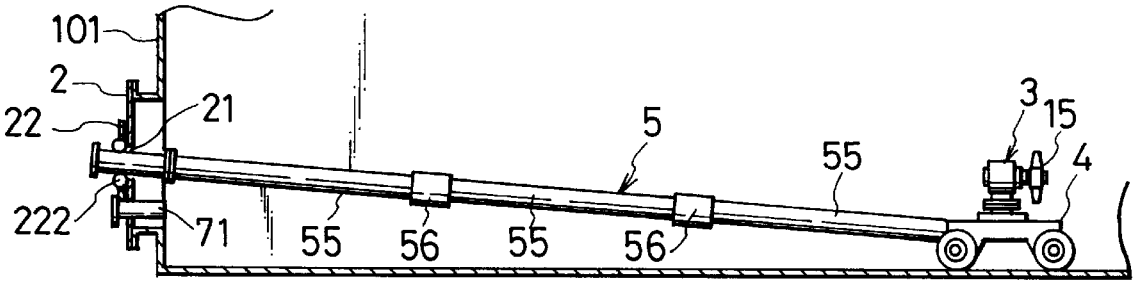

FIG. 7 shows a supply conduit 5 formed of steel pipes 55 and joints 56. The travelling apparatus 4 is a wheeled bogey. A plurality of steel pipes 55 joined by joints 56 are used, with the number of pipes depending on the distance involved. The pipes 55 are pushed into the tank 101, moving the travelling apparatus 4 forward. Inside the tank 101, the spraying machine 3 on the travelling apparatus 4 can thus be moved a required distance in a straight line by joining together an appropriate number of pipes 55. For this configuration, the cover 2 is provided with an opening 21 via which the pipes 55 can be inserted into the tank 101 to move the spraying machine 3 forward into position, or via which the pipes 55 can be withdrawn to move the spraying machine 3 back. The opening 21 is covered by a second cover 22 to maintain airtightness between the inside and the outside of the tank 101.

Figure 8:
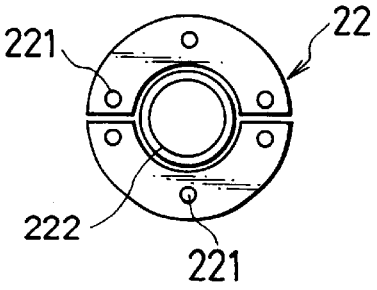
FIG. 8 is an enlarged front view of the second cover of the apparatus shown in FIG. 7.

FIG. 8 shows the general arrangement of the second cover 22. Thus, the second cover 22 consists of two halves, and has bolt holes 221 which are used to bolt the second cover 22 to the cover 2. The space between the steel pipe 55 and the second cover 22 is filled with a suitable sealing material 222.

The second cover 22 is attached to the cover 2 after the operation of lengthening or shortening the steel pipe 55 has been completed.

In the foregoing the present invention has been described with reference to the embodiments. However, it is to be understood that the invention is not limited to the above embodiments, and that the invention may be practiced otherwise than as specifically described herein, as long as any such modification does not depart from the scope of the appended claims.

Thus, as described in the foregoing, in accordance with the present invention a travelling apparatus on which a spraying machine for spraying washing liquid is mounted is moved to a desired position inside a tank to allow sludge in the tank to be fluidized and removed, quickly and efficiently.

Thus, the washing apparatus is not installed in the roof of the tank, which is the conventional configuration. Instead, the washing apparatus is inserted into the tank via a manhole or other such through-hole located in the lower part of the side wall of the tank, and is then moved freely around on the floor of the tank. This simplifies the setting up of the supply piping and facilitates maintenance, which are also desirable from the point of view of safety. Moreover, this arrangement provides washing apparatuses with a larger effective washing distance, thereby enabling washing to be effected quickly and efficiently with a small number of washing units and simplifying management of operations. As less equipment is required, equipment costs are reduced and the amount of time and labor needed to set up and remove temporary installations is also reduced. The present invention can also be applied to tanks that have a through-hole such as a manhole in the roof section. In such a case, just the cover of the washing apparatus of the invention is attached to the through-hole, and travelling apparatuses on which are mounted spraying machines are moved around on the floor of the tank to carry out the washing operation. Thus, unlike in a conventional arrangement, tank floating roofs are not subjected to the imposition of heavy loads, so there are no problems with respect to strength and safety.

Tanks can be washed even more efficiently by providing spraying machines with one drive source to reciprocally rotate a spray nozzle vertically and another drive source to reciprocally rotate the spray nozzle horizontally, and making it possible to control the drive sources from outside the tank while being able to ascertain the state of the spraying operation inside the tank.

Washing operations can also be smoothly implemented by also providing the same cover with a drain vent via which the fluidized sludge or other such solid matter concerned can be expelled from the tank.

What is claimed is:

1. A tank washing apparatus for washing oil tanks, comprising:

a cover that is detachably attached to a manhole located in a side wall of an oil tank of the oil tanks;

a travelling apparatus that is movable as desired by being operated from outside the oil tank;

a spraying machine that is mounted on said travelling apparatus for spraying washing liquid;

a supply conduit being connected to said spraying machine via said cover; and a means for confirming a position of said travelling apparatus inside said oil tank, wherein said means for confirming includes a light-emitting device equipped on said travelling apparatus, said light-emitting device emitting light via an optical fiber so at to enable the position of said travelling apparatus to be confirmed by observation through a peek-hole provided in said manhole.

2. The tank washing apparatus according to claim 1, wherein said supply conduit is connected to said spraying machine by a telescopic structure that includes a seal structure, a nozzle, and a space portion.

3. A method of washing an oil tank using a tank washing apparatus, said method comprising the steps of:

detachably attaching a cover of the tank washing apparatus to a manhole in the oil tank;

mounting a spraying machine that sprays washing liquid on a travelling apparatus of the tank washing apparatus;

connecting a washing liquid supply conduit to the spraying machine via the cover of the tank washing apparatus;

operating the travelling apparatus from outside of the oil tank to move the travelling apparatus as desired within the oil tank;

using a high pressure spray of liquid to fluidize solid matter on a floor portion of the oil tank; and confirming a position of the travelling apparatus within the oil tank, wherein said confirming of the position of the travelling apparatus inside of the oil tank includes equipping the travelling apparatus with a light-emitting device which emits a light via an optical fiber so as to enable the position of the travelling apparatus to be confirmed by observation through a peek-hole provided in the manhole.

4. A tank washing apparatus for washing oil tanks, comprising:

emitting device enabling said position of said traveling apparatus to be confirmed by observation.

5. The tank washing apparatus according to claim 4, wherein said supply conduit is connected to said spraying machine by a telescopic structure that includes a seal structure, a nozzle, and a space portion.

* * * * *

UNITED STATES PATENT AND TRADEMARK OFFICE

CERTIFICATE OF CORRECTION

PATENT NO. : 6,321,754 B1 
DATED : November 27, 2001
INVENTOR(S) : Nobuyuki Manabe et al.

It is certified that error appears in the above-identified patent and that said Letters Patent is hereby corrected as shown below:

Column 8,
Line 30, after the word "comprising:" please delete:
"emitting device enabling said position of said traveling apparatus to be confirmed by observation.", and insert:
-- a cover that is detachably attached to a manhole located in a side wall of an oil tank of the oil tanks to be washed;
a travelling apparatus that is movable as desired by being operated from outside of the oil tank;
a spraying machine that is mounted on said travelling apparatus for spraying washing liquid;
a supply conduit being connected to said spraying machine via said cover; and --

Signed and Sealed this

Thirtieth Day of July, 2002

*Attest:*

*Attesting Officer*

JAMES E. ROGAN
*Director of the United States Patent and Trademark Office*